US005150549A

United States Patent [19]

Chen

[11] Patent Number: 5,150,549

[45] Date of Patent: Sep. 29, 1992

[54] ANCHOR PILE AND CONCRETE PROTECTION WALL CONSTRUCTION USING SAID ANCHOR PILE

[76] Inventor: Chin-Lung Chen, No. 55-2, Pen-Chou Rd., Kang-Shan Chen, Kaohsiung Hsien, Taiwan

[21] Appl. No.: 816,261

[22] Filed: Jan. 3, 1992

[51] Int. Cl.[5] ..... E02D 5/74

[52] U.S. Cl. ..... 52/162; 52/155

[58] Field of Search ..... 52/153, 154, 155, 156, 52/158, 160, 161, 162; 405/259, 248, 260

[56] References Cited

U.S. PATENT DOCUMENTS

| | | | |
|---|---|---|---|
| 1,376,854 | 5/1921 | Bearse | 52/155 |
| 2,343,350 | 3/1944 | Warren | 52/156 |
| 3,012,644 | 12/1961 | Bush | 52/162 |
| 3,187,858 | 6/1965 | Des Champs | 52/160 |
| 3,861,497 | 1/1975 | Patterson et al. | 52/160 X |
| 3,924,371 | 12/1975 | Kidwell | 52/161 |
| 4,453,845 | 6/1984 | Donar, Jr. | 52/161 X |
| 4,592,178 | 6/1986 | Lu | 52/155 |
| 4,593,500 | 6/1986 | Watson | 52/155 X |

FOREIGN PATENT DOCUMENTS

| | | | |
|---|---|---|---|
| 217439 | 12/1909 | Fed. Rep. of Germany | 52/160 |
| 2216924 | 10/1989 | United Kingdom | 52/154 |

*Primary Examiner*—David A. Scherbel
*Assistant Examiner*—Creighton Smith
*Attorney, Agent, or Firm*—Beveridge, DeGrandi & Weilacher

[57] ABSTRACT

A concrete protection wall construction for a mountainside uses an anchor pile which includes an elongated tubular member extending into the moutainside and having a rear end and a front end with an annular recess formed therein, a shaft slidably extending into the tubular member and having a first end portion which extends out of the rear end of the tubular member and which projects out of the mountainside and a second end portion which extends out of the front end of the tubular member and which is provided with an enlarged head, and a foldable anchor having at least one anchor arm, which is pivoted to the second end portion of the shaft inward of the enlarged head and which extends radially outward, and a curved anchor flange integrally connected to the anchor arm. A reinforcing bar assembly is installed adjacent to the mountainside and is tied to the first end portion of the shaft. A concrete wall is then formed on the mountainside and is reinforced by the reinforcing bar assembly.

10 Claims, 8 Drawing Sheets

ANCHOR PILE AND CONCRETE PROTECTION WALL CONSTRUCTION USING SAID ANCHOR PILE

BACKGROUND OF THE INVENTION

1. Field of the Invention

The invention relates to an anchor pile, more particularly to an anchor pile and a concrete protection wall construction using said anchor pile.

2. Description of the Related Art

FIG. 1 is an illustration of a concrete protection wall (3) formed on a mountainside (11) along a mountain road (21) using conventional engineering techniques. The protection wall (3) minimizes erosion of the mountainside (11) and can resist impact forces which otherwise might cause landslides.

The protection wall (3) extends to a predetermined depth below the surface of the road (21) and is provided with a reinforcing bar assembly (31). The reinforcing bar assembly (31) includes a plurality of reinforcing bars (311) which extend into the mountainside (11). The reinforcing bars (311) are straight, slender rods which are driven into the mountainside (11). The retaining effect of the reinforcing bars (311) is relatively poor since the ends thereof are not enlarged and are not provided with anchors.

SUMMARY OF THE INVENTION

Therefore, the main objective of the present invention is to provide a concrete protection wall construction for a moutainside, which wall construction uses an anchor pile to reinforce and position the same on the mountainside.

Accordingly, the preferred embodiment of a concrete protection wall construction which uses the anchor pile of the present invention comprises an anchor pile including: an elongated tubular member extending into a mountainside and having a rear end and a front end with an annular recess formed therein; a shaft slidably extending into the tubular member and having a first end portion which extends out of the rear end of the tubular member and which projects out of the mountainside and a second end portion which extends out of the front end of the tubular member and which is provided with an enlarged head; and a foldable anchor means having at least one anchor arm, which is pivoted to the second end portion of the shaft inward of the enlarged head and which extends radially outward, and a curved anchor flange integrally connected to the anchor arm. A reinforcing bar assembly is installed adjacent to the mountainside and is tied to the first end portion of the shaft. A concrete wall is then formed on the mountainside and is reinforced by the reinforcing bar assembly.

BRIEF DESCRIPTION OF THE DRAWINGS

Other features and advantages of the present invention will become apparent in the following detailed description of the -preferred embodiments, with reference to the accompanying drawings, of which.

DETAILED DESCRIPTION OF THE PREFERRED EMBODIMENTS

Figure 1:
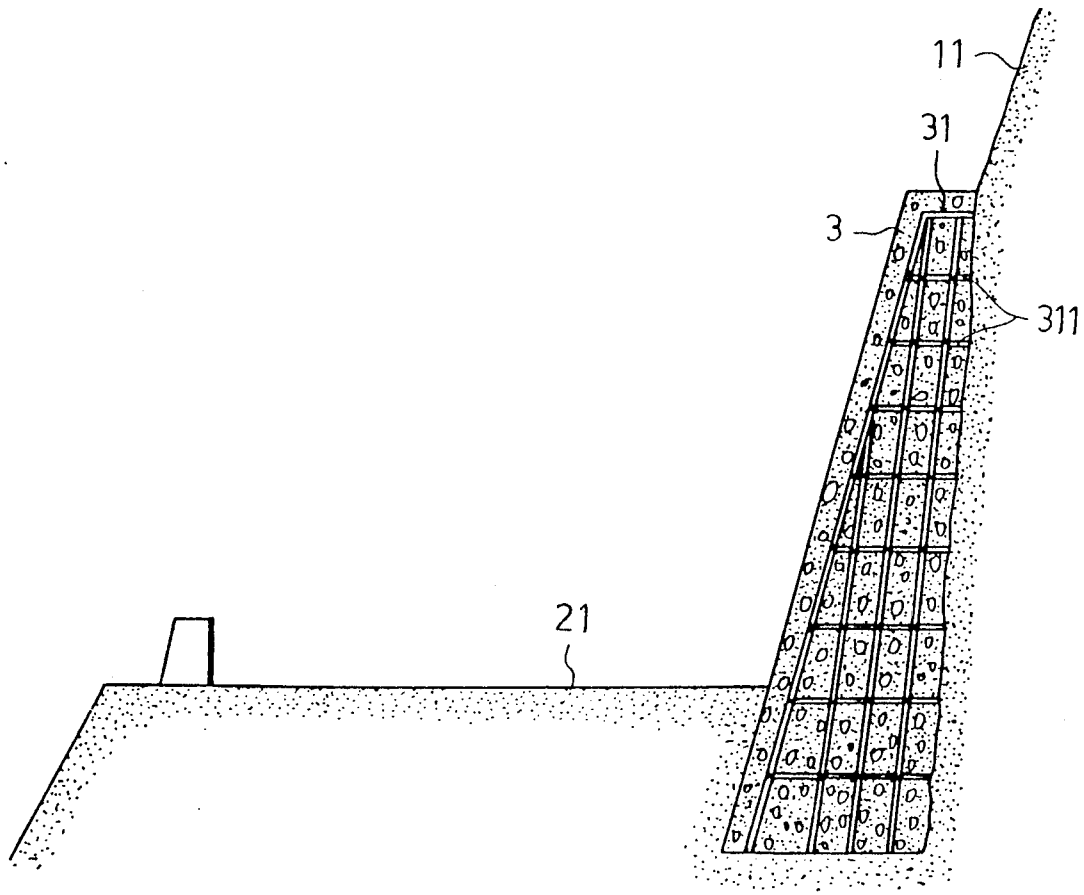
FIG. 1 PRIOR ART
FIG. 1 is an illustration of a conventional concrete protection wall construction formed on a mountainside.
Figure 2:
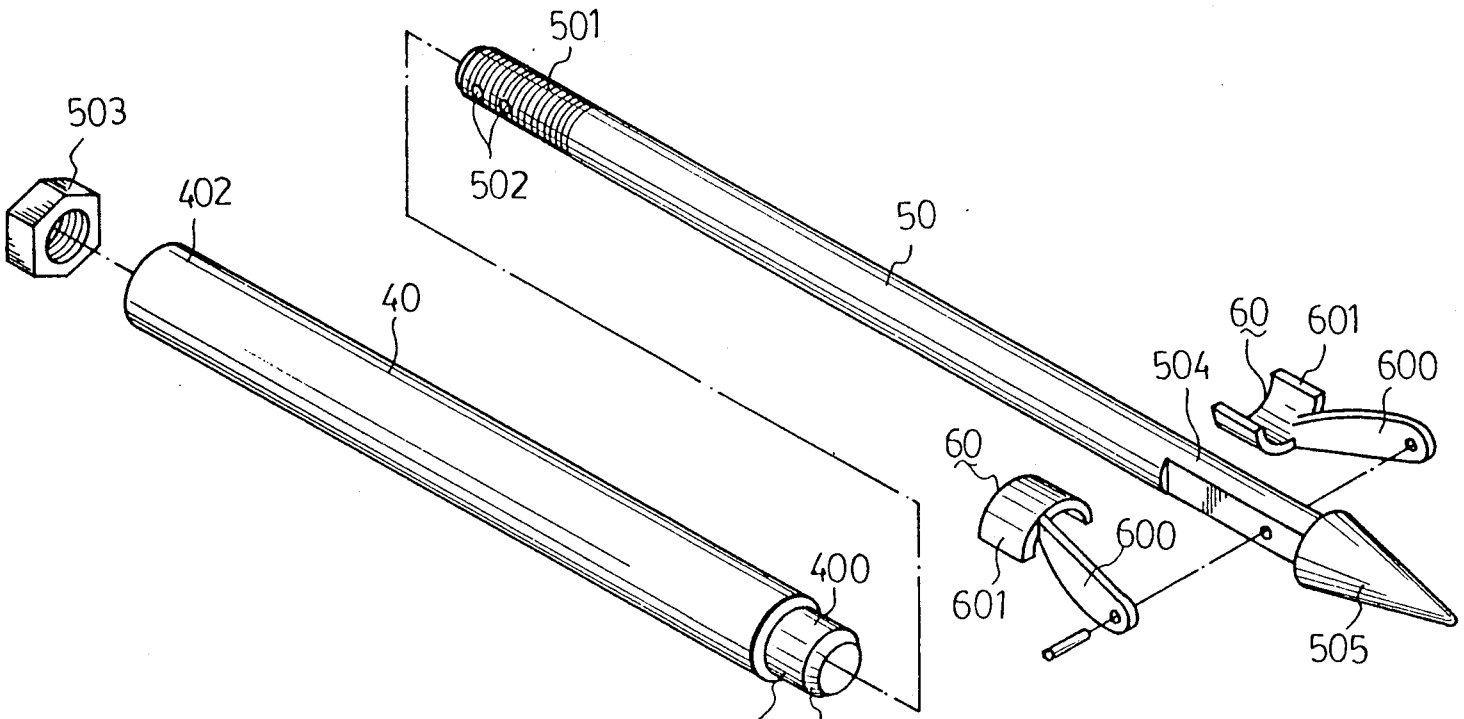
FIG. 2 is an exploded view of the first preferred embodiment of an anchor pile according to the present invention.
Figure 3:
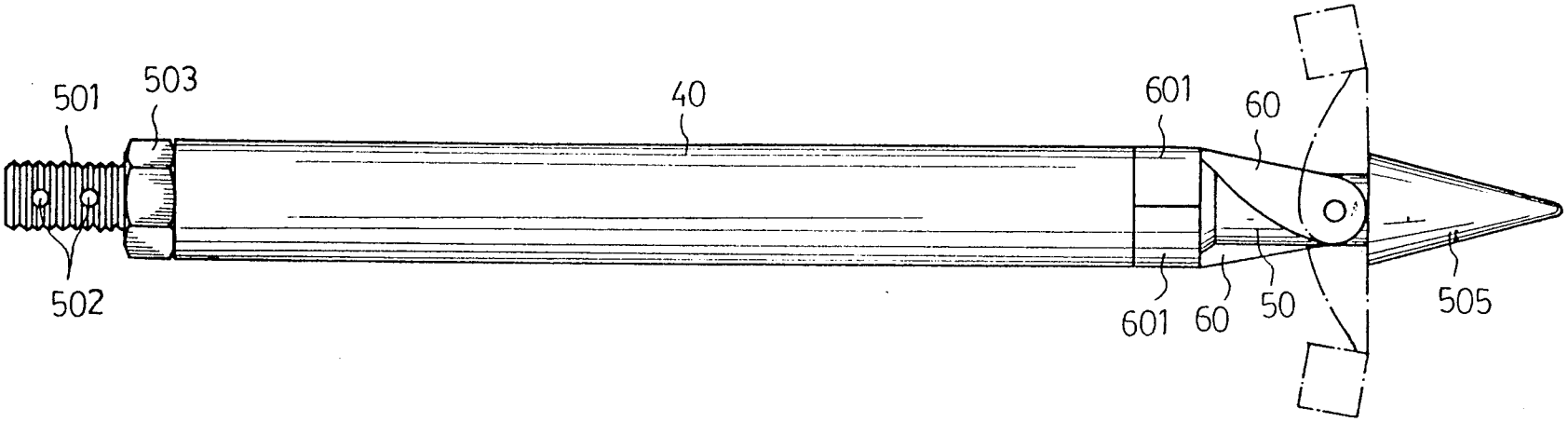
FIG. 3 illustrates the assembly of the first preferred embodiment.

Referring to FIGS. 2 and 3, the first preferred embodiment of an anchor pile according to the present invention is shown to comprise an elongated tubular member (40), a shaft (50) and a pair of foldable anchors (60).

The tubular member (40) has a rear end (402) and a front end (400) formed with an annular recess (400*a*) and a beveled end face (401). The shaft (50) slidably extends into the tubular member (40) and has a threaded first end portion (501) which extends out of the rear end (402) of the tubular member (40) and a second end portion (504) which extends out of the front end (400) of the tubular member (40) and which is provided with an enlarged conical head (505). Each of the foldable anchors (60) includes a substantially teardrop-shaped anchor arm (600) and a curved anchor flange (601) integrally connected to a narrow end portion of the anchor arm (600). The anchor arm (600) has a larger end portion pivoted to one side of the second end portion (504) of the shaft (50) inward of the conical head (505). The anchor flanges (601) of the foldable anchors (60) are extended over the front end (400) of the tubular member (40) and form a smooth, even surface with the outer surface of the tubular member (40) when the foldable anchors (60) are folded. The threaded first end portion (501) of the shaft (50) is formed with a pair of spaced transverse bores (502). A nut (503) engages the first end portion (501) and is operable to unfold the foldable anchors (60), as will be detailed in the succeeding paragraphs. The anchor arms (600) extend radially outward and abut the conical head (505) when the foldable anchors (60) are unfolded, as indicated by the phantom lines in FIG. 3. The conical head (505) thus limits the unfolding movement of the foldable anchors (60) to a maximum of 90°.

Figure 4:
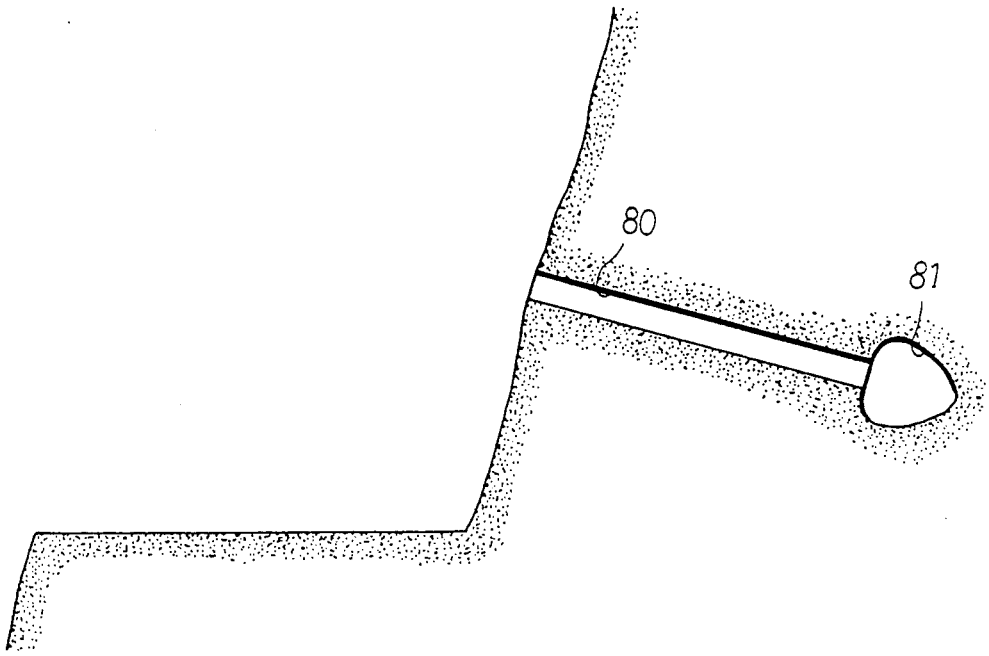
FIGS. 4 to 7 illustrate the formation of the preferred embodiment of a concrete protection wall construction according to the present invention using the anchor pile shown in FIGS. 2 and 3.

FIGS. 4 to 7 illustrate the formation of a concrete protection wall construction according to the present invention. Referring to FIG. 4, before the anchor pile of the first preferred embodiment can be installed, a bore (80) is formed on a mountainside using conventional boring techniques. The innermost end of the bore (80) is an enlarged cavity (81). Tiny bits of sand and stones in the bore (80) are removed before the surface defining the bore (80) is coated with a concrete layer by means of a conventional spraying technique. [The depth and the diameter of the bore (80) depends upon the soil properties of the mountainside].

Figure 5:
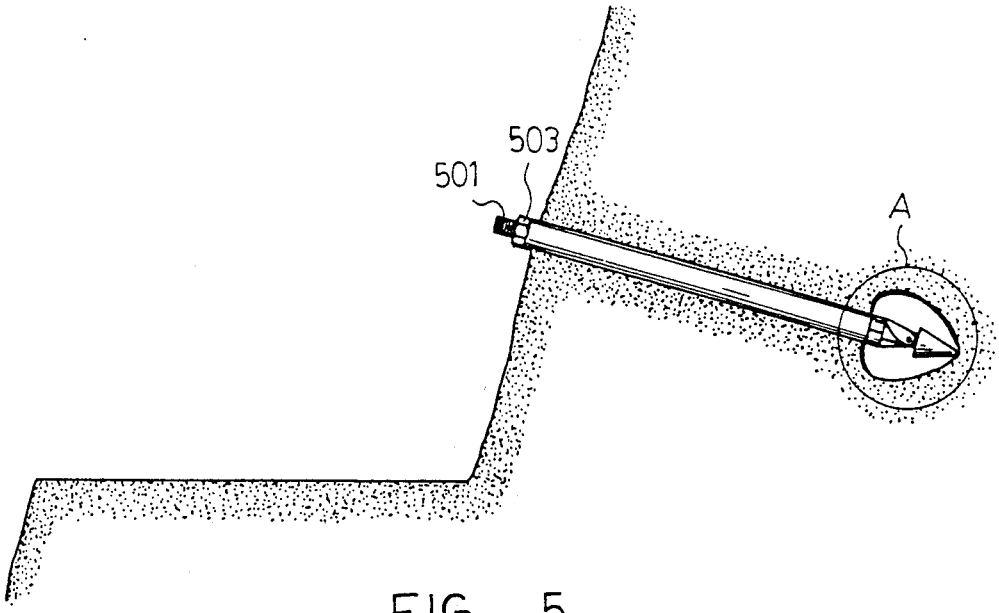

Referring to FIG. 5, after the bore (80) has been formed, the anchor pile of the first preferred embodiment is inserted into the bore (80) such that the conical head (505) extends into the enlarged cavity (81) and the nut (503) and the threaded end portion (501) project out of the bore (80).

Figure 8:
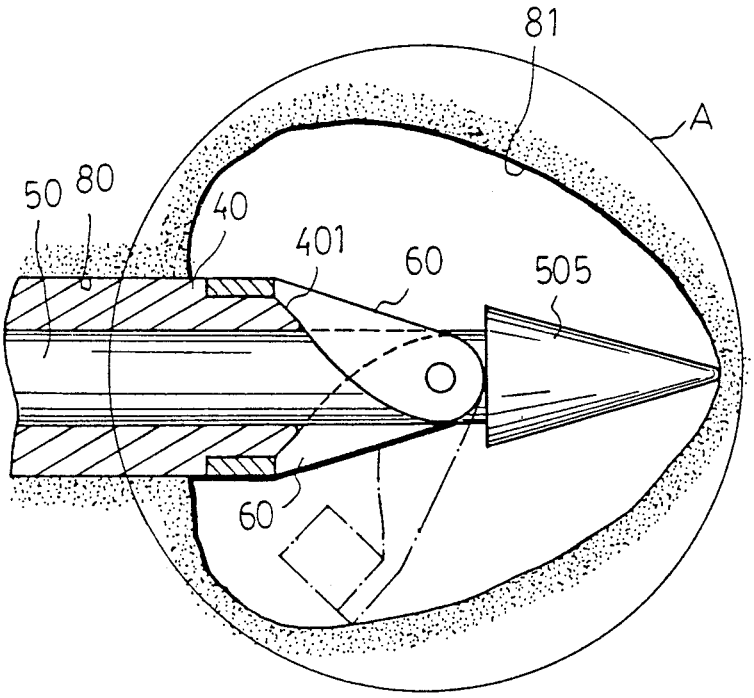
FIG. 8 is an enlarged view of an encircled portion (A) of FIG. 5.

Referring to FIG. 8, which is an enlarged view of an encircled portion (A) of FIG. 5, the head (505) is conical so as to guide the entry of the anchor pile into the bore (80) [The bore- (80) has been cleared beforehand]. The foldable anchors (60) are initially folded when the first preferred embodiment is inserted into the bore (80). The first preferred embodiment can be easily inserted into the bore (80) since the curved flanges (601) of the foldable anchors (60) are received in the annular recess (400*a*) and form a smooth even surface with the outer surface of the tubular member (40) at this stage. When the foldable anchors (60) reach the enlarged cavity (81), it is possible that one of the foldable anchors (60) will pivot to the unfolded position because of gravity (as indicated by the phantom lines). This does not affect the succeeding wall formation steps.

Figure 6:
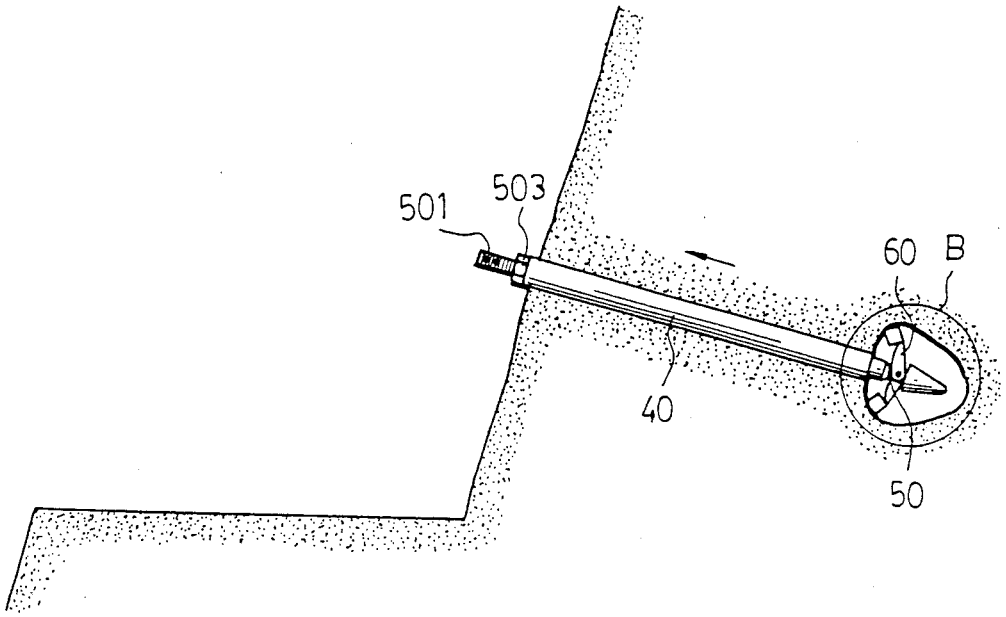
Figure 9:
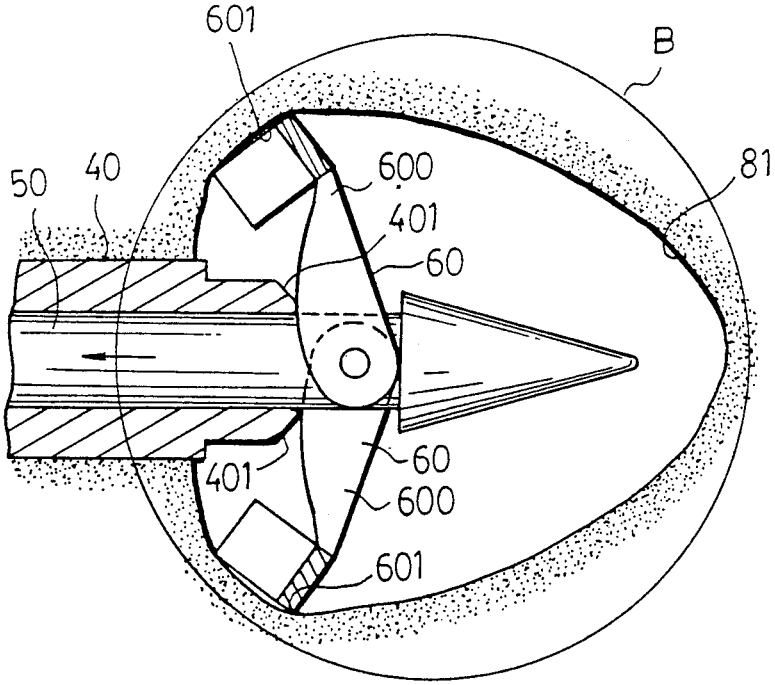
FIGS. 9 and 10 are enlarged views of an encircled portion (B) of FIG. 6.
Figure 10:
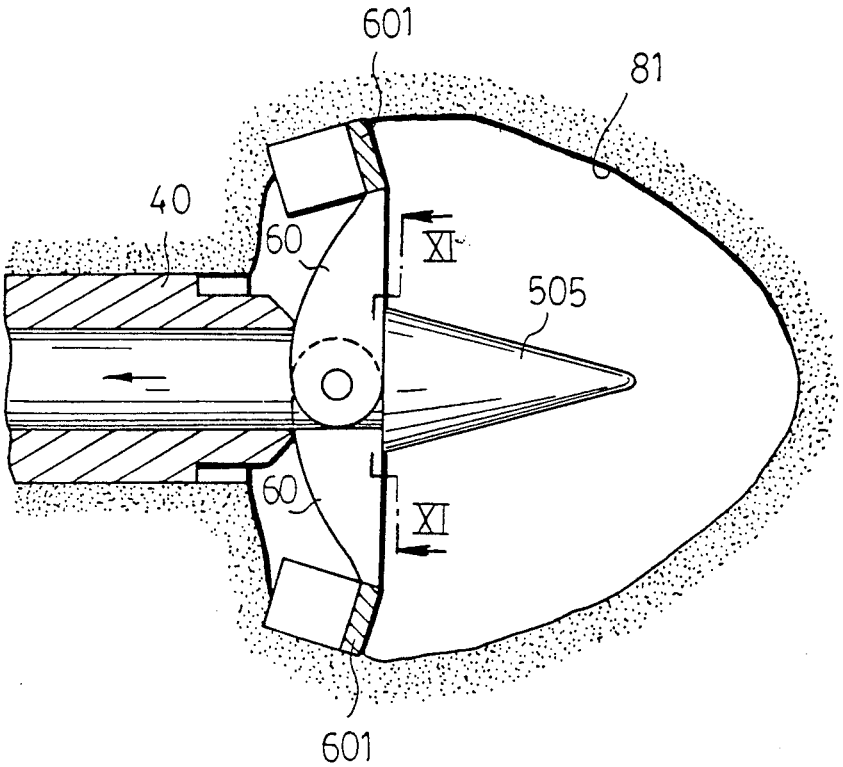
Figure 11:
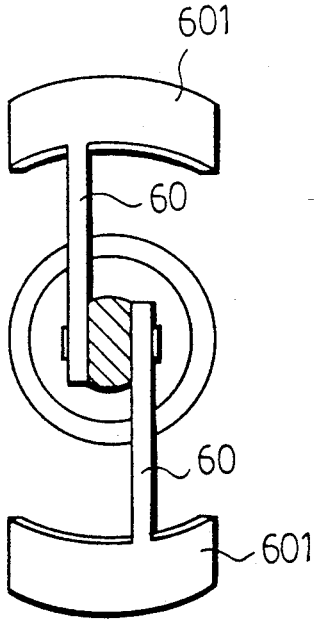
FIG. 11 is an XI—XI section of FIG. 10.

Referring to FIG. 6, after the first preferred embodiment has been inserted into the bore (80), the nut (503) is then operated so as to move the shaft (50) inwardly relative to the tubular member (40). Referring to FIG. 9, which is an enlarged view of an encircled portion (B) of FIG. 6, as the shaft (50) moves inwardly relative to the tubular member (40), the anchor arms (600) of the foldable anchors (60) abut the beveled end face (401) at the front end (400) of the tubular member (40), thereby causing the foldable anchors (60) to pivot to the unfolded position until the anchor flanges (601) firmly abut the surface defining the enlarged cavity (81). Referring to FIGS. 10 and 11, depending upon the soil properties and the size of the enlarged cavity (81), the nut (503) may be further operated so as to move the shaft (50) further inward until the anchor arms (600) abut the conical head (505) and the anchor flanges (601) dig into the soil, thereby providing a better retaining effect. The anchor flanges (601) can also prevent cave-in at the enlarged cavity (81).

Figure 7:
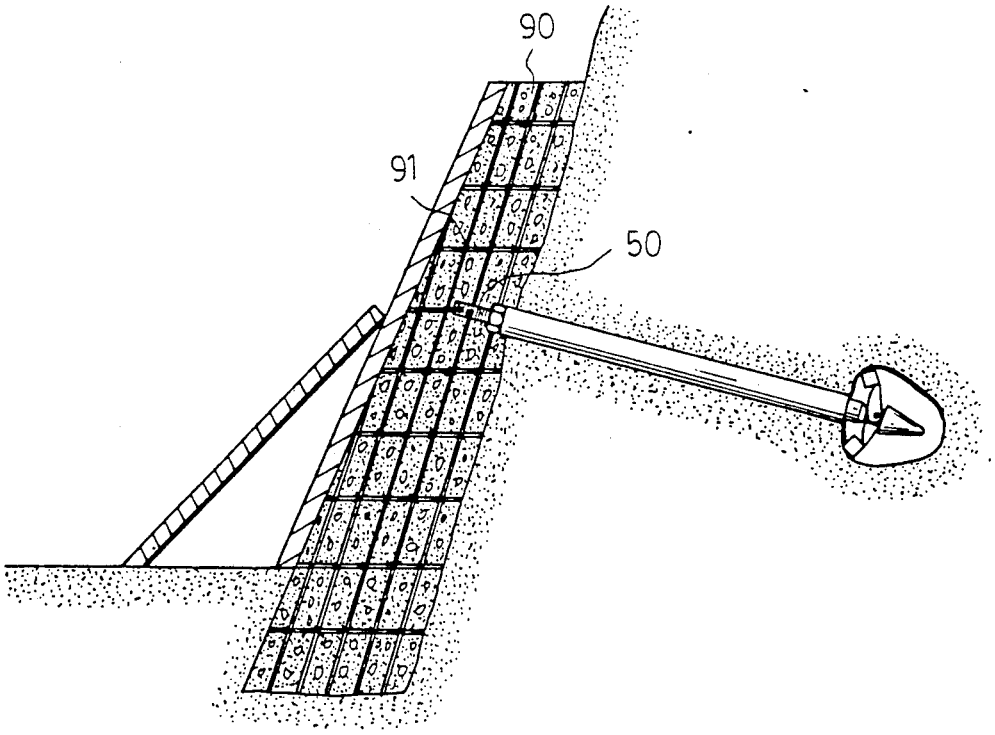

Referring to FIG. 7, after the nut (503) has been operated so as to unfold the foldable anchors (60) and permit firm engagement of the foldable anchors (60) with the surface defining the enlarged cavity (81), a reinforcing bar assembly (91) is then installed adjacent to the mountainside and is tied to the threaded end portion (501) of the shaft (50). Tying of the reinforcing bar assembly (91) is achieved by bending two reinforcing bars so as to extend through the transverse through bores (502) of the shaft (50) (Refer to FIGS. 2 and 3). After the reinforcing bar assembly (91) has been installed, a concrete wall (90) is then formed on the mountainside and is reinforced by the reinforcing bar assembly (91). The anchor pile engages the reinforcing bar assembly (91) so as to reinforce and position the concrete protection wall (90) on the mountainside. More than one anchor pile may be inserted into the mountainside along the length of the concrete wall (90) so as to provide a better reinforcing effect.

Figure 12:
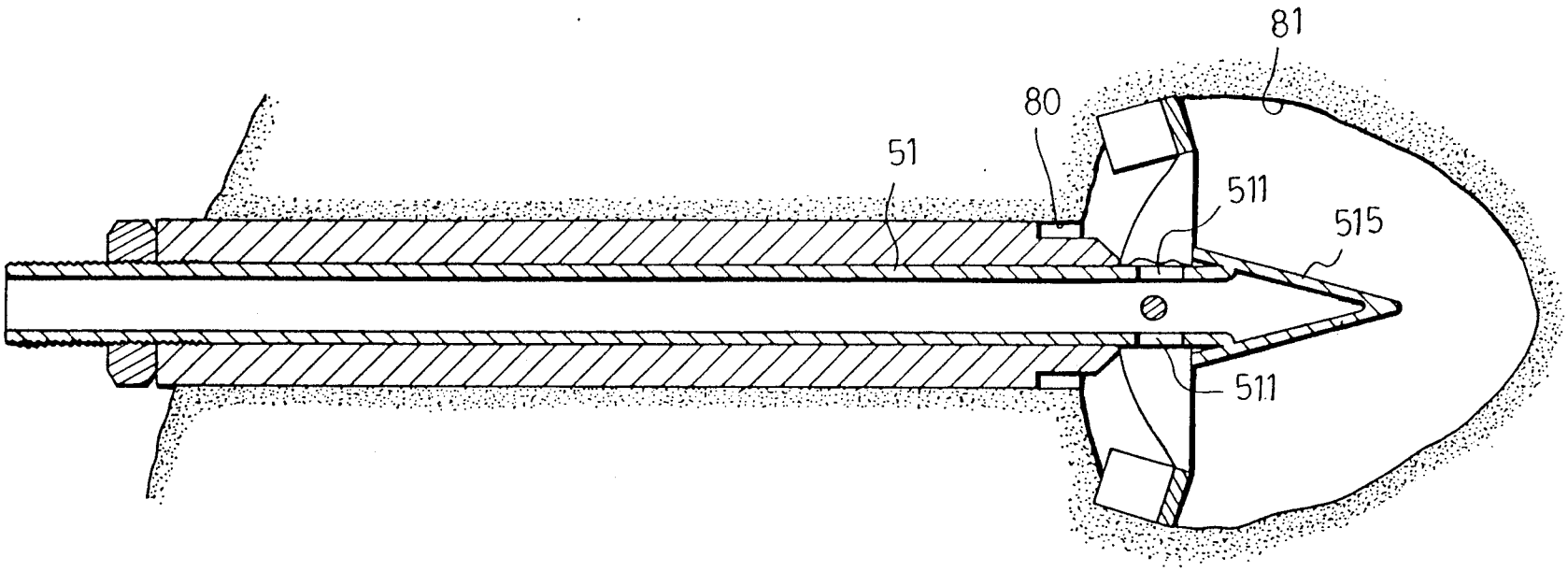
FIG. 12 an illustration of the second preferred embodiment of an anchor pile when installed on a mountainside.

FIG. 12 is an illustration of the second preferred embodiment of an anchor pile according to the present invention when installed on a mountainside. The main difference between the first and second preferred embodiments is that the shaft (51) of the second preferred embodiment is hollow. The shaft (51) is further provided with openings (511) adjacent to the enlarged conical head (515). If the soil properties of the mountainside are relatively poor, concrete may be injected into the enlarged cavity (81) via the shaft (51) so as to effectively retain the second preferred embodiment in the bore (80).

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An anchor pile for reinforcing a concrete protection wall on a mountainside, comprising:

an elongated tubular member having a rear end and a front end, with an annular recess formed therein;

a shaft slidably extending into said tubular member and having a first end portion which extends out of said rear end of said tubular member and a second end portion which extends out of said front end of said tubular, member and which is provided with an enlarged head; and a foldable anchor means having at least one anchor arm, which is pivoted to said second end portion of said shaft inward of said enlarged head and which extends radially outward when in use, and a curved anchor flange integrally connected to said anchor arm, said anchor flange being extended over said front end of said tubular member and being received in said annular recess when said anchor is folded.

2. The anchor pile as claimed in claim 1, wherein said front end of said tubular member has a beveled end face.

3. The anchor pile as claimed in claim 1, wherein said enlarged head is conical in shape.

4. The anchor pile as claimed in claim 1, wherein said first end portion of said shaft is threaded, and said anchor pile further comprises a nut member engaging said first end portion of said shaft and being operable to move said shaft inwardly relative to said tubular member.

5. The anchor pile as claimed in claim 1, wherein said shaft is hollow and is provided with at least one opening adjacent to said enlarged head.

6. A concrete protection wall construction for a mountainside, comprising:

an anchor pile including: an elongated tubular member extending into the mountainside and having a rear end and a front end with an annular recess formed therein; a shaft slidably extending into said tubular member and having a first end portion which extends out of said rear end of said tubular member and which projects out of the mountainside and a second end portion which extends out of said front end of said tubular member and which is provided with an enlarged head; and a foldable anchor means having at least one anchor arm, which is pivoted to said second end portion of said shaft inward of said enlarged head and which extends radially outward, and a curved anchor flange integrally connected to said anchor arm;

a reinforcing bar assembly installed adjacent to the mountainside and tied to said first end portion of said shaft; and a concrete wall formed on said mountainside and being reinforced by said reinforcing bar assembly.

7. The concrete protection wall construction as claimed in claim 6, wherein said front end of said tubular member has a beveled end face.

8. The concrete protection wall construction as claimed in claim 6, wherein said enlarged head is conical in shape.

9. The concrete protection wall construction as claimed in claim 6, wherein said first end portion of said shaft is threaded, and said anchor pile further comprises a nut member engaging said first end portion of said shaft and being operable to move said shaft inwardly relative to said tubular member.

10. The concrete protection wall construction as claimed in claim 6, wherein said shaft is hollow and is provided with at least one opening adjacent to said enlarged head.

* * * * *